US012000143B2

(12) United States Patent
Gosling et al.

(10) Patent No.: US 12,000,143 B2
(45) Date of Patent: Jun. 4, 2024

(54) WALL LEVELER AND FLOOR INTERFACING COMPONENT SYSTEM

(71) Applicant: DIRTT ENVIRONMENTAL SOLUTIONS LTD., Calgary (CA)

(72) Inventors: Geoff W. Gosling, Calgary (CA); Thomas A. Brown, Calgary (CA); Jeremy J. Klaas, Green Bay, WI (US)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 0 days.

(21) Appl. No.: 17/765,510

(22) PCT Filed: Dec. 9, 2020

(86) PCT No.: PCT/US2020/064073
§ 371 (c)(1),
(2) Date: Mar. 31, 2022

(87) PCT Pub. No.: WO2021/119167
PCT Pub. Date: Jun. 17, 2021

(65) Prior Publication Data

US 2022/0364359 A1 Nov. 17, 2022

Related U.S. Application Data

(60) Provisional application No. 62/946,106, filed on Dec. 10, 2019.

(51) Int. Cl.
*E04B 2/74* (2006.01)

(52) U.S. Cl.
CPC ..... *E04B 2/7422* (2013.01); *E04B 2002/749* (2013.01)

(58) Field of Classification Search
CPC ..... E04B 2/7422; E04B 2002/749
See application file for complete search history.

(56) References Cited

U.S. PATENT DOCUMENTS 3,608,266 A * 9/1971 Satkin et al. ..... E04B 2/7854 52/511
4,235,495 A * 11/1980 Propst ..... E04B 2/821 174/101

(Continued)

FOREIGN PATENT DOCUMENTS

DE 102004054430 A1 * 5/2006 ..... E04B 2/7448
EP 0302564 A2 * 2/1989

OTHER PUBLICATIONS

International Preliminary Report on Patentability received for PCT Patent Application No. PCT/US2020/064073, dated Jun. 23, 2022, 8 pages.

(Continued)

*Primary Examiner* — Theodore V Adamos
(74) *Attorney, Agent, or Firm* — Workman Nydegger

(57) ABSTRACT

A modular wall system includes a leveler disposed within a wall module. The leveler includes a base to which floor interfacing members of the modular wall system connect. As the leveler adjusts the height of the wall module, the base to which the floor interfacing members attach remain stationary. During installation, the bottom edges of the floor interfacing members can be trimmed to form a consistent gap below the floor interfacing members.

19 Claims, 6 Drawing Sheets

(56) References Cited

U.S. PATENT DOCUMENTS

| | | | | | |
|---|---|---|---|---|---|
| 4,449,337 | A * | 5/1984 | Gzym | E04B 2/825 | 52/242 |
| 5,381,994 | A * | 1/1995 | Welch | H02G 3/288 | 174/497 |
| 5,901,512 | A * | 5/1999 | Bullwinkle | H02G 3/288 | 52/239 |
| 5,974,742 | A * | 11/1999 | Schreiner | A47B 21/06 | 52/239 |
| 6,889,477 | B1 * | 5/2005 | Kottman | E04B 2/7422 | 52/64 |
| 8,024,901 | B2 | 9/2011 | Gosling et al. | | |
| RE46,929 | E * | 7/2018 | Gosling | E04B 2/7424 | |
| 11,085,184 | B2 * | 8/2021 | Gosling | E04B 2/7451 | |
| 2002/0157335 | A1 * | 10/2002 | Vos | E04B 2/821 | 52/239 |
| 2004/0154267 | A1 * | 8/2004 | Burken | E04B 2/7422 | 52/782.1 |
| 2017/0314262 | A1 * | 11/2017 | Kopish | E04B 2/7455 | |
| 2021/0355677 | A1 * | 11/2021 | Gosling | E04B 2/7427 | |

OTHER PUBLICATIONS

International Search Report and Written Opinion for PCT/US2020/064073 dated Feb. 25, 2021.

* cited by examiner

WALL LEVELER AND FLOOR INTERFACING COMPONENT SYSTEM

CROSS-REFERENCE TO RELATED APPLICATION

The present application is a US 371 Nationalization of International Application No. PCT/US2020/064073, filed Dec. 9, 2020, which claims the benefit of priority to U.S. Patent Application No. 62/946,106, filed Dec. 10, 2019, and entitled WALL LEVELER AND FLOOR INTERFACING COMPONENT SYSTEM. The entire content of each of the aforementioned patent applications is incorporated herein by reference.

BACKGROUND

1. Technical Field

The present invention relates generally to systems, methods, and apparatus for forming, assembling, and installing modular wall systems. More specifically, the present invention relates to leveling apparatus and floor interfacing component for modular wall systems.

2. Related Art

Office space can be relatively expensive, not only due to the basic costs of the location and size of the office space, but also due to any construction needed to configure the office space in a particular way. Furthermore, as an organization's needs change, it is often necessary to have a convenient and efficient means to reconfigure the existing office space rather than having to move to a new office space. Many organizations address their configuration and reconfiguration issues by dividing large, open office spaces into individual work areas using modular wall systems.

Modular wall systems are relatively easy to configure, less expensive to set up, and reconfigured more easily than more permanently constructed office dividers. Manufacturers or designers typically design such modular walls and partitions to include a series of individual wall panels that can be assembled together to form a range of different configurations. These wall panels are usually connected to one or more structural components that form a frame-type structure of the modular wall.

Leveling modular wall systems, including individual panels thereof, can be difficult. When a modular wall system is installed within a room that includes floors or ceilings that are not perfectly level, the modular wall panels must be adjusted accordingly. When certain panels are adjusted to compensate for uneven floors or ceilings, various panels may separate, leaving unsightly gaps between panels, or there may not be sufficient room to install panels at the top and bottom of the modular system.

Accordingly, there are a number of problems in the prior art that need to be addressed.

BRIEF SUMMARY

Embodiments of the present disclosure extend to systems, methods, and apparatus for forming, assembling, and installing modular wall systems. More specifically, the present disclosure relates to leveling apparatus and floor interface components for modular wall systems. For example, in one embodiment of the present disclosure, a modular wall system includes a wall module, a leveler disposed within an interior space of the wall module, and a floor interfacing member secured to the leveler.

In one embodiment of the present disclosure, a modular wall system includes a wall panel and a leveler disposed within an interior space of the wall module. The leveler includes a base. The modular wall system also includes a floor interfacing member secured to the base of the leveler.

In one embodiment of the present disclosure, a method of installing a modular wall system includes first securing a leveler within a wall module of a modular wall system. The method also includes adjusting the height of the wall module via a leveler and securing a floor interfacing member to the leveler.

Additional features and advantages of exemplary embodiments of the invention will be set forth in the description which follows, and in part will be obvious from the description or may be learned by the practice of such exemplary embodiments. The features and advantages of such embodiments may be realized and obtained by means of the instruments and combinations particularly pointed out in the appended claims. These and other features will become more fully apparent from the following description and appended claims or may be learned by the practice of such exemplary embodiments as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Embodiments of the present disclosure extend to systems, methods, and apparatus for forming, assembling, and installing modular wall systems. More specifically, the present disclosure relates to leveling apparatus and floor interface components for modular wall systems. For example, in one embodiment of the present disclosure, a modular wall system includes a wall module, a leveler disposed within an interior space of the wall module, and a floor interfacing member secured to the leveler.

The embodiments of leveling apparatus and floor interfacing components and systems for modular wall systems described herein solve a number of problems in the art noted above. For example, one or more embodiments of the present disclosure include floor interfacing members that are separately connected to the base of the levelers such that regardless of the adjustment of the wall modules of the wall system, the floor interfacing members maintain an aesthetically pleasing transition from the wall modules to the floor. Even as the wall modules of the system are adjusted toward or away from the floor, the floor interfacing members extend all the way to the floor and can be conveniently trimmed before installation to form a consistent gap between the floor interfacing members and the adjusted wall modules.

Figure 1:
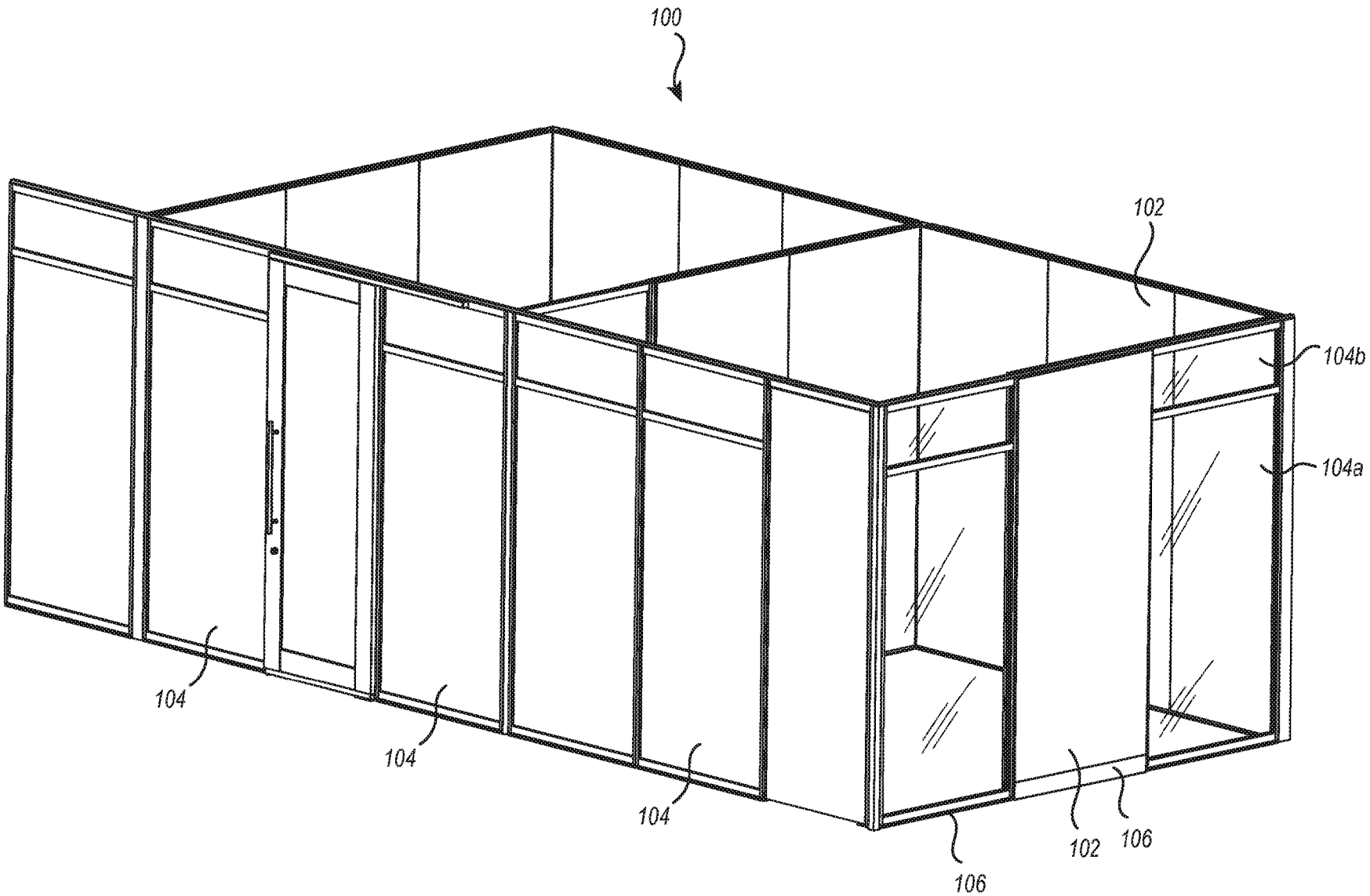
FIG. 1 illustrates a modular wall system, according to an embodiment of the present disclosure.

Turning now to the Figures, FIG. 1 illustrates an exemplary modular wall system 100 with wall modules 102, 104. The wall modules 102, 104 may have similar or different characteristics from one another. Other embodiments of the modular wall system 100 may include any number of combinations of wall modules 102, 104 arranged together or separately to form modular spaces and partitions. In at least one embodiment, for example, the modular wall system 100 may only include wall modules 104 or may only include wall modules 102.

The wall system 100 may include one or more modules disposed above and/or below one another, such as the various sections of wall modules 104*a*, 104*b* illustrated. For example, one upper wall module 104*b* may be disposed above another lower wall module 104*a* and joined together via a horizontal connection component.

In addition, at least one embodiment of the modular wall system 100 includes one or more floor interfacing components 106. Each floor interfacing component 106 may comprise a horizontally disposed elongate member extending along the bottom of one or more of the lower wall modules 104*a* or wall modules 102. In at least one embodiment, each wall module 102, 104 of the wall system 100 can include one individual floor interfacing component 106. In at least one embodiment, a floor interfacing component 106 of the wall system 100 spans two or more wall modules 102, 104. Each floor interfacing component 106 may provide an aesthetically pleasing transition or connection between the modular wall system 100 and a floor.

In most cases, as noted above, floors on which modular wall systems 100 are installed are not perfectly level. As such, at least one embodiment of the modular wall system 100 includes leveling components that support the various wall modules 102, 104 from below and allow installers to level the wall modules 102, 104 across uneven surfaces and floors.

Figure 2:
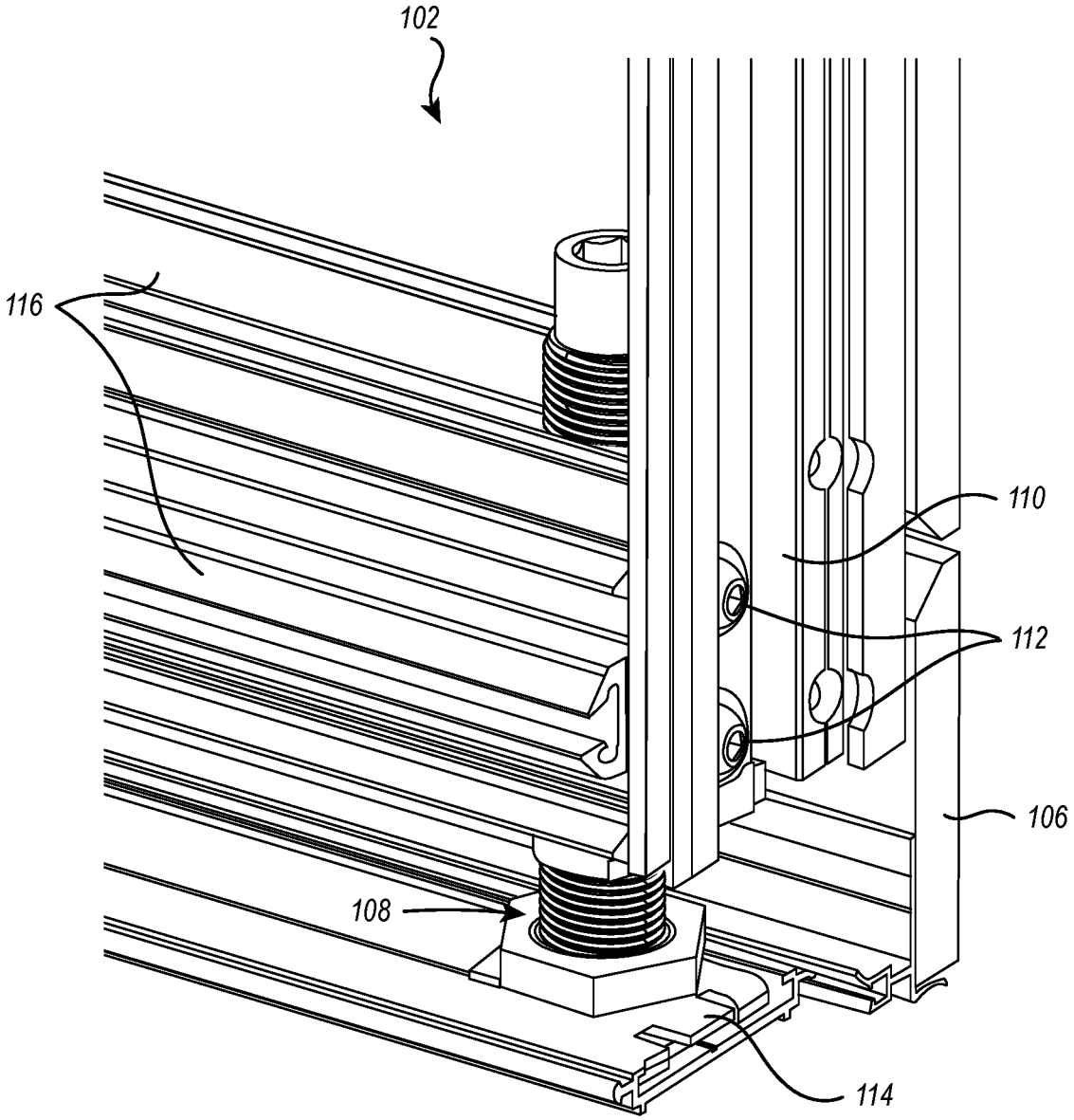
FIG. 2 illustrates a leveler disposed within the interior space of a wall module of a modular wall system, according to an embodiment of the present disclosure.

In FIG. 2, exterior portions of a wall module 102 have been removed to illustrate the internal components thereof. A leveler 108 is connected directly to a lower portion of a vertical member 110 of the wall module 102 via bolts 112 or one or more other securement means. The leveler 108 may be used by an installer to adjust the height of the end of the wall module 102 to which the leveler is secured.

FIG. 2 also shows an example of a floor interfacing component 106. In at least one embodiment, the floor interfacing component 106 attaches to the base 114 of the leveler 108. In this way, the leveler 108 ensures that a lower edge of the floor interfacing component 106 remains near or at the floor to provide an aesthetically pleasing interface therewith.

Figure 3:
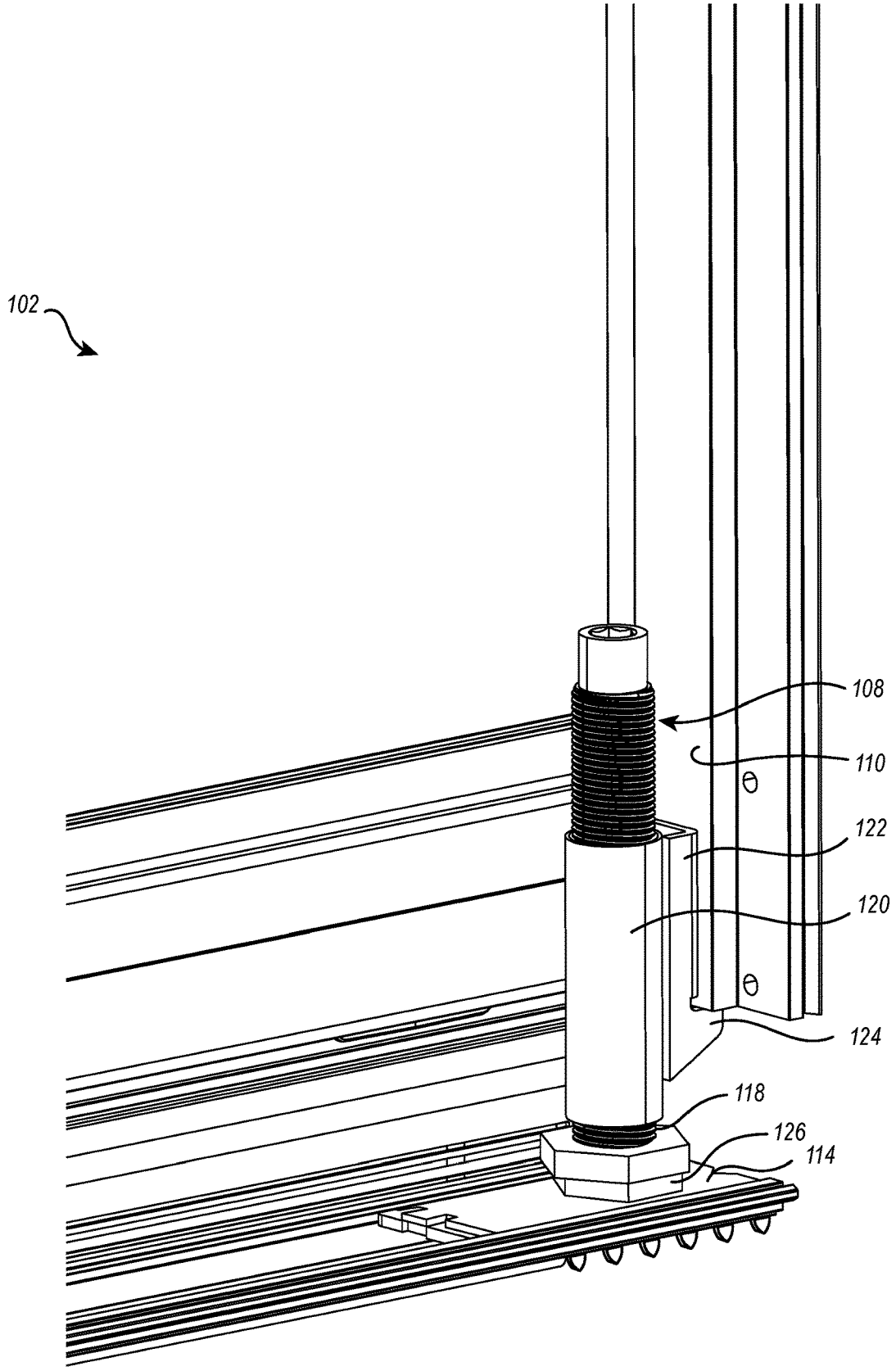
FIG. 3 illustrates another view of a leveler disposed within the interior space of a wall module of a modular wall system, according to an embodiment of the present disclosure.

Also, as shown in FIG. 2, in at least one embodiment, the leveler 108 is disposed at least partially between two opposing horizontal members 116 forming portions of a frame of the wall module 102. FIG. 3 illustrates another view of the wall module 102 without one of the horizontal members 116 to visually expose more of the leveler 108. While the leveler 108 is shown and described as being disposed between two opposing horizontal members 116 and connected to a vertical member 110, it will be appreciated that this is merely exemplary. In other embodiments, the leveler 108 may be connected to one or more horizontal members and/or one or more vertical members. Additionally, the leveler 108 may be connected to an interior or exterior surface of the horizontal and/or vertical members.

In at least one embodiment, the leveler 108 includes a male threaded member 118 extending vertically from the base 114. A female threaded sleeve 120 engages with the male threaded member 118. The female threaded sleeve 120 is secured to the vertical member 110 of the wall module 102 via a bracket 122. In at least one embodiment, the bracket 122 may include a shelf 124 that supports the vertical member 110 from the lower end thereof.

In at least one embodiment, the male threaded member 118 is rotatably secured to the base 114 such that the male threaded member 118 can rotate relative to the base. The male threaded member 118 may have a nut 126 securely mounted thereon. Alternatively, the male threaded member 118 may include one or more flats thereon. The nut 126 or flats may be engaged and rotated. Rotation of the nut 126 or flats causes the male threaded member 118 to rotate. The rotation of the male threaded member 118 in turn causes the sleeve 120 to travel up or down relative to the male threaded member 118, thus causing the vertical member 110 and corresponding wall module 102 to travel up and down as needed for leveling during installation.

Figure 4:
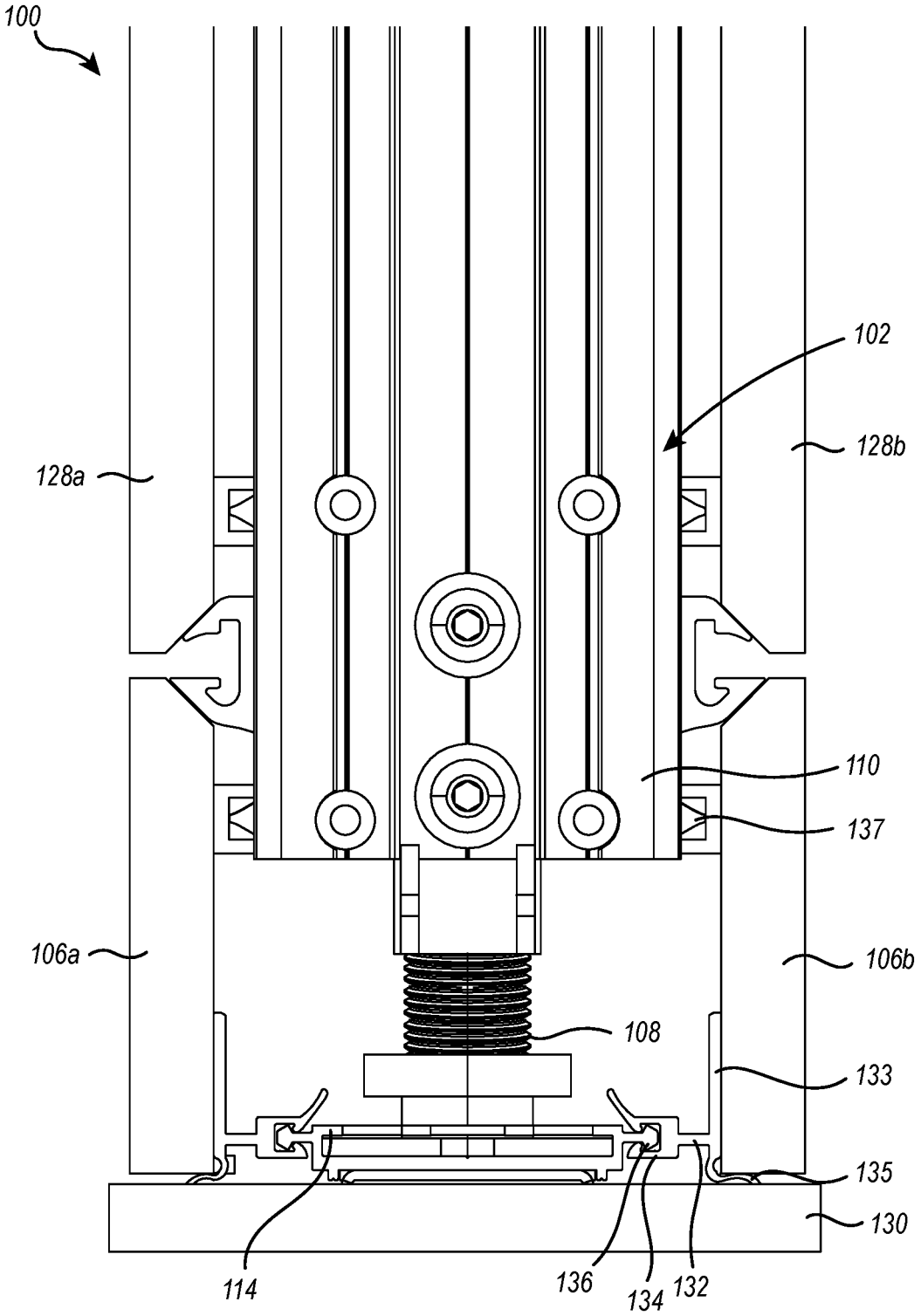
FIG. 4 illustrates an end view of a wall module showing a leveler disposed within the interior space of the wall module of a modular wall system, according to an embodiment of the present disclosure.
Figure 5:
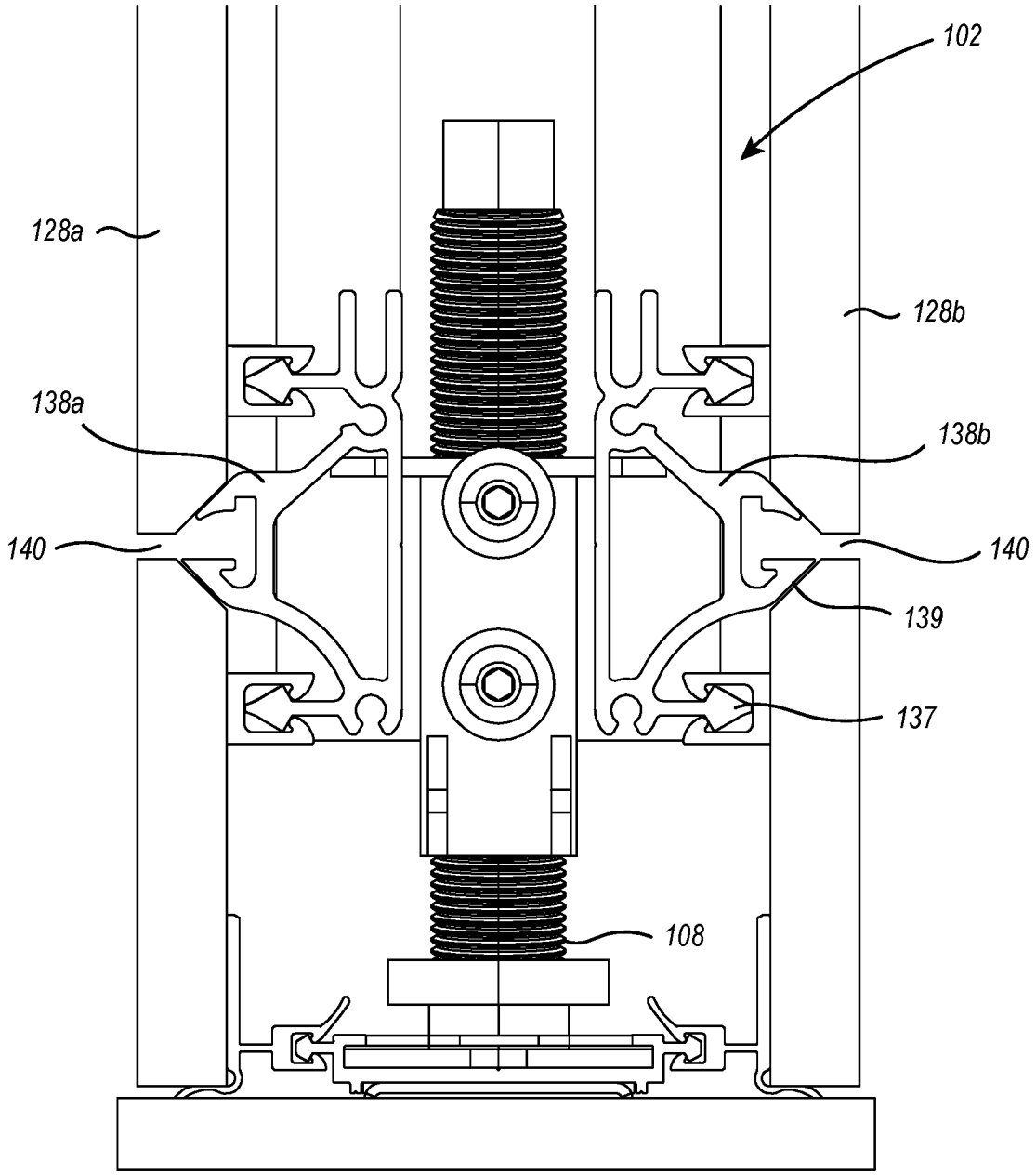
FIG. 5 illustrates a cross-sectional view of a wall module showing a leveler disposed within the interior space of the wall module of a modular wall system, according to an embodiment of the present disclosure.

As seen from the end view and cross-sectional view of the modular wall system 100 in FIGS. 4 and 5, the leveler 108 engages the vertical member 110 in order to adjust the height of the end of the wall module 102. In doing so, as the leveler 108 lifts up or down on the vertical member 110, opposing outer members or panels 128*a*, 128*b* of the wall module 102 also lift up or down because the panels 128*a*, 128*b* are connected to the internal frame members of the wall module 102 along with the vertical member 110. Consequently, the distance between a lower edge of each panel 128*a*, 128*b* and the floor 130 may vary as the wall module 102 is leveled across an uneven floor.

The leveler 108 shown and described herein may be considered a two stage leveler as a result of the two components (the male threaded member 118 and the sleeve 120) that can move relative to one another. It will be appreciated that such a leveler is merely exemplary. For instance, other types of levelers may be used with embodiments disclosed herein. For instance, a multi-stage telescopic leveler may be employed. Such levelers may include one or more male threaded members and one or more threaded sleeves. For instance, a three-stage leveler may include a male threaded member (similar to threaded member 118), a first sleeve, and a second sleeve. The first sleeve may include a female thread therein that mates with the male threaded member. The first sleeve may also include an external thread. The second sleeve may include a female thread therein that is configured to mate with the external thread of the first sleeve. The male threaded member and the first sleeve may be configured to move axially relative to one another and the first sleeve and the second sleeve may be configured to axially relative to one another. The movement of the male threaded member, the first sleeve, and the second sleeve may be used to adjust the height of a wall module in a similar manner as discussed herein relative to leveler 108.

The floor interfacing components 106*a*, 106*b* are secured to the base 114 of the leveler 108 so that the floor interfacing components 106*a*, 106*b* may be trimmed to fit consistently close to the floor 130 after height adjustments are made to the wall module 102 via the leveler 108. In at least one embodiment, each floor interfacing component 106*a*, 106*b* is removably secured to the base 114 of the leveler 108 via a clip extrusion 132. In at least one embodiment, the floor interfacing component 106 is rigidly secured to the clip extrusion 132. Additionally, the clip extrusion 132 may include a channel 134 that receives a beaded protrusion 136 extending from the base 114 of the leveler 108. In this way, each floor interfacing component 106*a*, 106*b* may be removably secured to the leveler and remain consistently near or at the floor 130 after adjustments of the leveler 108 and height of the wall module 102.

The clip extrusions 132 may be configured to maintain the floor interfacing component 106*a*, 106*b* in a generally vertical orientation. For instance, each clip extrusion 132 may include a vertical wall 133 that connects to a rear or inner surface of the floor interfacing components 106*a*, 106*b*. Additionally, each clip extrusion 132 may also include a leg 135 that extends at least partially under the associated floor interfacing component. As can be seen in FIG. 4, the leg 135 may have a generally arcuate shape. The arcuate shape of the legs 135 may bias the floor interfacing component 106*a*, 106*b* towards a vertical orientation. Additionally, the legs 135 may also provide a somewhat flexible seal to the floor 130, to prevent passage of sound or airflow from one side of the wall to the other.

FIG. 5 illustrates the system of FIG. 4 without the vertical member 110 for illustrative purposes. Additionally or alternatively to clip extrusion 132 and beaded protrusion 136 shown in FIGS. 4 and 5, as best seen in FIG. 5, the frame members of the wall module 102 (e.g., frame member 137) and the upper portions of the floor interfacing components 106*a*, 106*b* may include similar clip extrusion and beaded protrusion connections. In addition, as shown in FIG. 5, floor interfacing components 106*a*, 106*b* may also include an upper chamfer 139 that fits snuggly against opposing frame components 138*a*, 138*b* when installed. Upper clip extrusions discussed above may help ensure a proper mating between the chamfered edges 139 of the floor interfacing components 106*a*, 106*b* and opposing frame components 138*a*, 138*b*.

As noted above, the wall module 102 may include internal frame components, such as the opposing frame components 138*a*, 138*b* shown in FIG. 5. The internal frame components 138*a*, 138*b* include a number of protruding cantilever features that form connection points for the panels 128*a*, 128*b* and vertical member 110 that are part of the wall module 102.

A gap 140 may be formed between the floor interfacing members 106*a*, 106*b* and the panels 128*a*, 128*b*. Ideally, for aesthetic purposes, the gap 140 may be minimized and/or made consistent across the wall module 102 after the wall module 102 is adjusted via the levelers during installation. In at least one embodiment, a taller-than-necessary floor interfacing member 106 can be provided to an installer. After the height of the wall module 102 is adjusted as necessary via the leveler 108, the installer can trim the bottom edge and/or top edge of the floor interfacing member 106 so that the gap 140 is consistent horizontally across the wall module 102 and the floor interfacing members 106 extend all or substantially all the way to the floor. This can be done even when a floor 130 is not level, and so one end of a panel 106 may be shorter and the other end taller to provide a consistently close fit of a floor interfacing panel 106 to the unlevel floor. Preferably, the installer trims the bottom edge so that exposed material of the floor interfacing member 106 due to the cut faces down and out of sight.

In addition, an installer can trim the floor interfacing members 106 such that the bevel at the top, inner edge of the floor interfacing member 106, as shown in FIG. 5, seamlessly interfaces with, and/or connects to, one or more cantilever features of the internal frame components 138*a*, 138*b*, as shown. In this way, an installer can level the wall module 102 to accommodate an uneven floor while ensuring both that the floor interfacing members 106*a*, 106*b* remain flush against the floor and the gap 140 remains consistent and aesthetically pleasing along the wall module 102.

Figure 6:
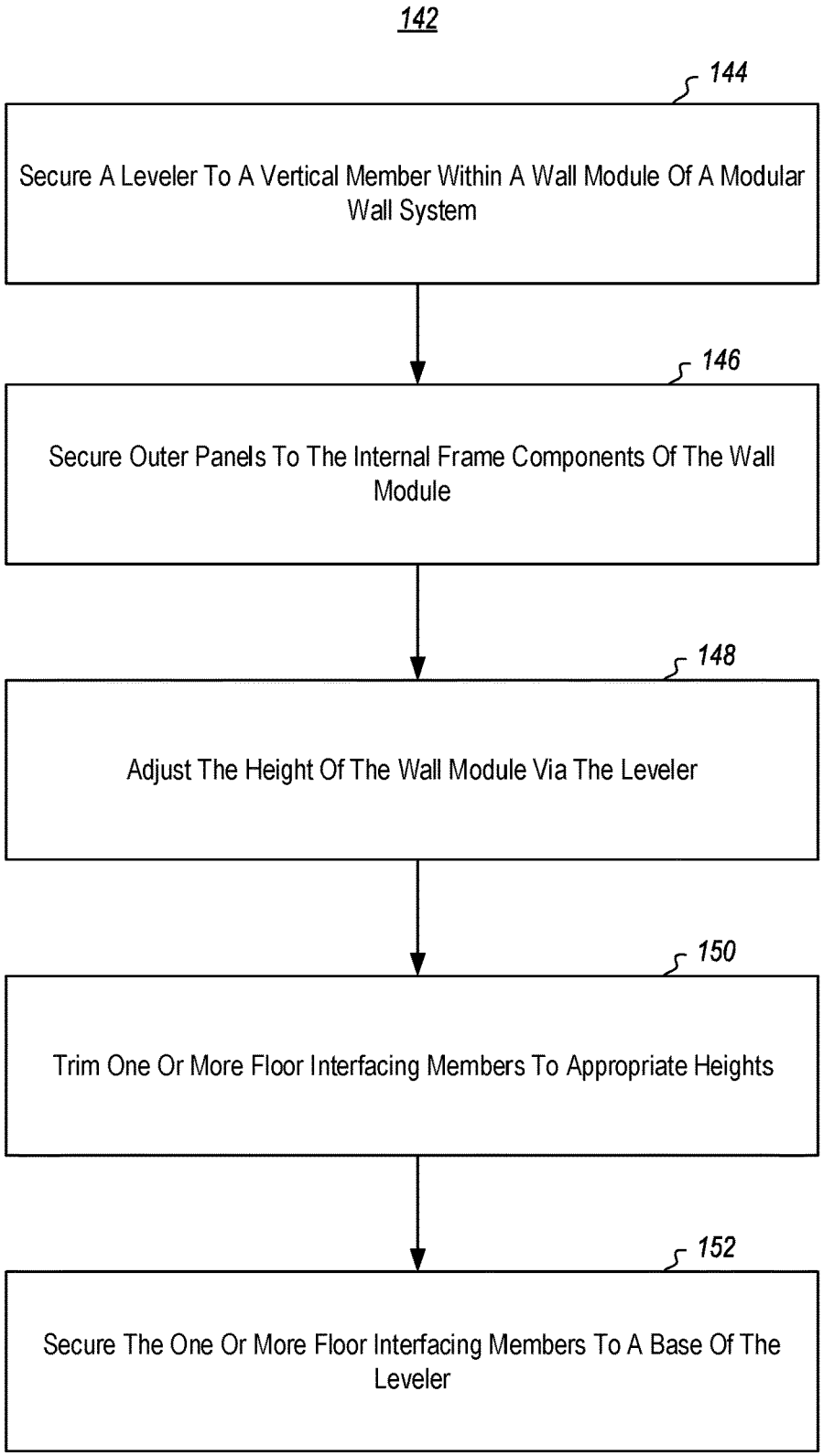
FIG. 6 illustrates a method of installing a modular wall system, according to an embodiment of the present disclosure.

Accordingly, as seen in FIG. 6, a method 142 for installing a modular wall system, according to the present disclosure, includes a first step 144 of securing a leveler within a wall module of a modular wall system. In some embodiments, the leveler is secured to the wall module while the wall module is laid in a horizontal orientation. Once the leveler is connected to the wall module, the wall module may be stood upright into a vertical orientation and secured in place. In at least one embodiment, a second step 146 of the method 142 includes securing outer panels to internal frame components of the wall module. In at least one embodiment, the method 142 includes a third step 148 of adjusting the height of the wall module via the leveler. In some embodiments, adjusting the height of the wall module via the leveler is performed before the outer panels are secured to the frame components of the wall module. In at least one embodiment, the method 142 includes a fourth step 150 of trimming one or more floor interfacing members to appropriate heights. In at least one embodiment, the method 142 includes a fifth step 152 of securing the one or more floor interfacing members to a base of the leveler.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A modular wall system, comprising:

a wall module having an exterior surface;

a leveler disposed within an interior space of the wall module, the leveler being configured to adjust a height of the wall module;

a floor interfacing member secured to the leveler, the floor interfacing member having an exterior surface;

wherein:

the leveler comprises a base having a beaded protrusion extending therefrom;

the floor interfacing member is rigidly secured to a clip extrusion, wherein the clip extrusion is configured to receive the beaded protrusion of the base of the leveler; and the exterior surface of the wall module and the exterior surface of the floor interfacing member are substantially flush.

2. The modular walls system of claim 1, wherein the wall module comprises a vertical member.

3. The modular wall system of claim 2, wherein the leveler is configured to be secured to the vertical member via a bracket.

4. The modular wall system of claim 1, wherein the leveler further comprises:

a male threaded portion vertically extending from the base;

a female threaded sleeve configured to engage the male threaded portion, wherein the female threaded sleeve is configured to be secured to the wall module.

5. The modular wall system of claim 4, wherein the male threaded portion is rotatably secured to the base, such that the male threaded portion is configured to rotate relative to the base.

6. The modular wall system of claim 5, wherein the male threaded portion includes a nut or one or more flats configured to be manipulated to rotate the male threaded portion during use.

7. The modular wall system of claim 6, wherein when the male threaded portion is rotated in a first direction during use, the female threaded sleeve is configured to travel upward and when the male threaded portion is rotated in a second direction during use, the female threaded sleeve is configured to travel downward.

8. The modular wall system of claim 1, wherein the clip extrusion includes a channel configured to receive the beaded protrusion extending from the base of the leveler.

9. The modular wall system of claim 8, wherein the floor interfacing member is configured to remain consistently flush with a floor onto which the modular wall system is disposed regardless of whether the wall module is adjusted up or down via the leveler during installation.

10. A modular wall system, comprising:

a wall module;

a leveler configured to be disposed within an interior space of the wall module and being configured to adjust a height of the wall module, the leveler comprising a base;

a floor interfacing member configured to be secured to the base of the leveler;

wherein:

the base comprises a beaded protrusion extending therefrom;

the floor interfacing member is configured to be secured to the base of the leveler via a flexible clip, wherein the flexible clip is rigidly secured to the floor interfacing member and is configured to receive the beaded protrusion of the base of the leveler; and the floor interfacing member and the wall module are aligned in an end-to-end configuration with an exterior surface of the wall module being generally flush with an exterior surface of the floor interfacing member.

11. The modular wall system of claim 10, wherein the leveler is configured to adjust a height of the wall module above a floor onto which the modular wall system is installed.

12. The modular wall system of claim 10, wherein the wall module comprises a vertical member to which an adjustable sleeve of the leveler is secured.

13. The modular wall system of claim 10, wherein the floor interfacing member is configured to remain stationary as the wall panel is adjusted up or down by the leveler during use.

14. A method of installing a modular wall system, the method comprising:

securing a leveler within a wall module of a modular wall system;

adjusting the height of the wall module via the leveler; and securing a floor interfacing member to the leveler;

wherein the leveler comprises:

a base, the base comprising a beaded protrusion extending therefrom;

a male threaded portion extending vertically from the base; and a female threaded sleeve configured to engage the male threaded portion, the female threaded sleeve being configured to be secured to the wall module;

wherein the floor interfacing member is configured to be secured to the base of the leveler via a flexible clip;

and wherein the wall module and floor interfacing member have substantially a same thickness, are arranged in an end-to-end configuration, and are substantially flush.

15. The method of claim 14, further comprising securing one or more outer panels to internal frame components of the wall module such that the one or more outer panels are adjusted by the leveler along with the wall module.

16. The method of claim 15, further comprising trimming the bottom edge of the floor interfacing member to an appropriate height.

17. The method of claim 16, wherein the appropriate height ensures that a gap between the floor interfacing member and the outer member is horizontally consistent along the wall module of the modular wall system.

18. The method of claim 14, wherein adjusting the height of the wall module via the leveler includes rotating the male threaded portion of the leveler.

19. The method of claim 14, wherein securing the floor interfacing member to the leveler includes securing the floor interfacing member to the base of the leveler so that the floor interfacing member remains stationary as the height of the panel is adjusted via the leveler.

* * * * *